US009166320B1

(12) United States Patent
Herring et al.

(10) Patent No.: US 9,166,320 B1
(45) Date of Patent: Oct. 20, 2015

(54) CABLE CONNECTOR ASSEMBLY

(71) Applicant: Tyco Electronics Corporation, Berwyn, PA (US)

(72) Inventors: Michael David Herring, Apex, NC (US); Michael John Phillips, Camp Hill, PA (US); Arash Behziz, Newbury Park, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/314,705

(22) Filed: Jun. 25, 2014

(51) Int. Cl.

| | |
|---|---|
| ***H01R 12/24*** | (2006.01) |
| ***H01R 12/79*** | (2011.01) |
| ***H01R 12/72*** | (2011.01) |
| ***H01R 13/6592*** | (2011.01) |

(52) U.S. Cl.
CPC ..... *H01R 12/79* (2013.01); *H01R 12/721* (2013.01); *H01R 13/6592* (2013.01)

(58) Field of Classification Search
CPC ..... H01R 13/6471; H01R 13/6593
USPC ..... 439/497, 607.41, 607.49
See application file for complete search history.

(56) References Cited

U.S. PATENT DOCUMENTS

| | | | | |
|---|---|---|---|---|
| 7,632,155 | B1 * | 12/2009 | Wu | 439/660 |
| 7,854,626 | B2 | 12/2010 | Ishida et al. | |
| 8,011,950 | B2 | 9/2011 | McGrath et al. | |
| 8,277,232 | B2 | 10/2012 | Herring et al. | |
| 2013/0149891 | A1 | 6/2013 | Schroll | |

* cited by examiner

*Primary Examiner* — Tho D Ta

(57) ABSTRACT

A cable contact module of a cable connector assembly includes a dielectric frame, signal contacts, and a ground frame. The signal contacts, held by the dielectric frame, include contact beams that extend from a front of the dielectric frame and electrically connect to signal contact pads on a mating circuit card. The signal contacts are terminated to corresponding cables that extend from a rear of the dielectric frame. Each cable includes at least one center conductor housed within a cable shield. The ground frame includes a ground plate and integral ground beams. The ground plate is mounted to the dielectric frame and engages the cable shields of the cables. Each ground beam extends from a front edge of the ground plate into a void defined between adjacent pairs of the contact beams. The ground beams are configured to electrically connect to ground contact pads on the mating circuit card.

19 Claims, 4 Drawing Sheets

CABLE CONNECTOR ASSEMBLY

BACKGROUND OF THE INVENTION

The subject matter herein relates generally to cable connector assemblies.

One type of electrical connector used in current electrical connections is configured to receive a mating edge of a circuit card or circuit board. The electrical connector may be termed a "straddle mount" or "board edge" connector. Typically, the electrical connector includes contacts that are biased against contact pads or conductors exposed on the surface of the mating circuit card to form an electrical signal path between the electrical connector and the circuit card. Optionally, the electrical connector may be a cable mount connector, such that the contacts are terminated to center conductors in one or more cables that extend from the electrical connector away from the circuit card. In some applications, the electrical connector and the attached circuit board form a subassembly for a further device in a broader communication system, and the one or more cables connect to another component in the communication system. One such use for the electrical connector is in the assembly of memory cards or other electronic devices.

As speed and performance demands increase, known electrical connectors are proving to be insufficient. Additionally, there is a trend to decrease the contact pitch between the contacts and between the contact pads in order to increase the density of the electrical connector and reduce the amount of area on the circuit card that the electrical connector covers. For cable mounted electrical connectors, each of the center conductors of the cables that terminate to the contacts of the electrical connector is typically covered in an insulative layer. The cables may be co-axial cables that include a conductive outer shield, an outer jacket, and possibly one or more other layers. Due to interference from the layers of material surrounding the center conductors of the cables, two adjacent center conductors may not be physically able to terminate to adjacent contacts that are spaced apart by a fine contact pitch. As a result, the size or gauge of the center conductors and/or of the cables may be limited to a small gauge or diameter in order to support the tighter pitch of the contacts and contact pads. However, smaller gauge conductors typically produce significant signal loss that increases (for example, gets worse) as the length of the cable used to convey the signal increases, due, in part, to the limited amount of conductive material through which the signal propagates. Thus, since the gauge of the cable conductors is limited for space reasons, the cable mount electrical connector may be limited to applications where the distance of the signal path is short enough to prohibit the negative effects of signal loss. A need remains for a cable mount electrical connector that is able to connect larger gauge center conductors of cables to narrow pitch contact pads on a mating circuit card to reduce signal loss over longer transmission distances.

BRIEF DESCRIPTION OF THE INVENTION

In one embodiment, a cable contact module is provided having a dielectric frame, signal contacts, and a ground frame. The dielectric frame has a front and a rear. The signal contacts are held by the dielectric frame. The signal contacts include contact beams that extend from the front of the dielectric frame and are configured to electrically connect to signal contact pads on a mating circuit card. The signal contacts are arranged in pairs with a void defined between the contact beams of adjacent pairs. The signal contacts are terminated to corresponding cables that extend from the rear of the dielectric frame. Each cable includes at least one center conductor housed within a cable shield. The ground frame includes a ground plate and integral ground beams. The ground plate is mounted to the dielectric frame and engages the cable shields of the cables. Each ground beam extends from a front edge of the ground plate into a corresponding void between adjacent pairs of the contact beams. The ground beams are configured to electrically connect to ground contact pads on the mating circuit card.

In another embodiment, a cable connector assembly is provided having a front housing, first and second cable contact modules, and a spacer. The front housing has a front and a rear. The front includes a mating interface configured to receive a mating edge of a mating circuit card. The first and second cable contact modules are received in the front housing. The first and second cable contact modules are separated from each other by a gap. Each cable contact module includes plural cables, a dielectric frame, and a ground frame. The cables each include at least one center conductor housed within a cable shield. The dielectric frame has a front and a rear and an outer side and an inner side. The dielectric frame holds multiple signal contacts. The signal contacts are terminated to the center conductors of the cables. The cables extend from the rear of the dielectric frame. The signal contacts include contact beams that extend from the front of the dielectric frame. The ground frame is mounted to the outer side of the dielectric frame. The ground frame includes a ground plate engaging the cable shields of the cables. The ground frame also includes integral ground beams extending from a front edge of the ground plate into corresponding voids defined between adjacent pairs of contact beams. The first and second cable contact modules oppose each other such that the inner sides of the dielectric frames face each other across the gap. The spacer has a first panel and a second panel coupled by a bridge. The spacer is disposed in the gap between the first and second cable contact modules. The first panel is configured to engage the cable shields of the cables along the inner side of the first cable contact module, and the second panel is configured to engage the cable shields of the cables along the inner side of the second cable contact module.

DETAILED DESCRIPTION OF THE INVENTION

Embodiments set forth herein include cable connector assemblies that have cable contact modules therein. The cable contact modules may be configured with a reduced contact spacing between adjacent signal contacts to accommodate circuit cards having a greater contact density within a defined contact area. Although the contact spacing is reduced, the cable contact modules of the cable connector assemblies may be configured to terminate to multiple cables that include relatively large gauge center conductors that are too large to connect directly to adjacent contact pads on the circuit card. The larger gauge conductors reduce signal loss over longer distances as compared to smaller gauge conductors. As such, the cable connector assemblies may allow for better signal transmission over longer distances than other assemblies that terminate to smaller gauge conductors. In addition, the cable connector assemblies are configured to electrically common the ground components of each of the cables and provide shielding between adjacent pairs of signal contacts, even with the reduced spacing between signal contacts.

Figure 1:
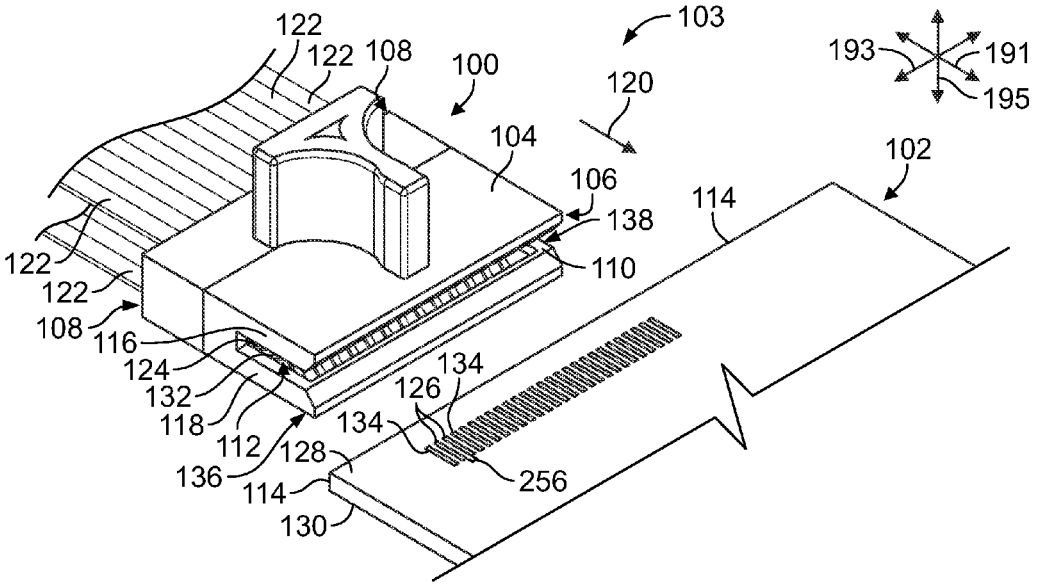
FIG. 1 is a perspective view of a cable connector assembly formed in accordance with an exemplary embodiment poised for mating to a circuit card.

FIG. 1 is a perspective view of a cable connector assembly 100 formed in accordance with an exemplary embodiment poised for mating to a circuit card 102. The cable connector assembly 100 and the circuit card 102 may be components of a communication system 103. For example, the cable connector assembly 100 and circuit card 102 may be part of or used with telecommunication systems or devices, such as a switch, router, server, hub, network interface card, personal computer, storage system, or the like. The communication system 103 is oriented with respect to a mating or insertion axis 191, a lateral axis 193, and an elevation axis 195. The axes 191, 193, 195 are mutually perpendicular with respect to one another. Although the elevation axis 195 appears to extend in a vertical direction parallel to gravity in FIG. 1, it is understood that the axes 191, 193, 195 are not required to have any particular orientation with respect to gravity.

The cable connector assembly 100 is configured to receive at least a portion of the circuit card 102 to electrically connect the cable connector assembly 100 to the circuit card 102 and establish an electrical signal path therebetween. For example, the cable connector assembly 100 may be moved towards the circuit card 102 in a mating direction 120 parallel to the insertion axis 191 to mate the two components. The circuit card 102 may be referred to herein as a mating circuit card 102. The mating circuit card 102 may be a daughter card or a mother board and include conductive traces (not shown) extending therethrough. As used herein, the term "circuit card" refers to an electrical circuit in which the conductors have been printed or otherwise deposited in predetermined patterns on an insulating substrate. The mating circuit card 102 in one or more embodiments may be a printed circuit board.

The cable connector assembly 100 includes a housing 104. The housing 104 has a front 106 and a rear 108. A mating interface 110 is disposed at the front 106 of the housing 104. In an embodiment, the mating interface 110 defines a slot 112 that receives a mating edge 114 of the mating circuit card 102 therein. The housing 104 further includes an upper wall 116 that defines the slot 112 from above and a lower wall 118 that defines the slot 112 from below. The slot 112 may extend from a left end 136 of the housing 104 to a right end 138 of the housing 104. As used herein, relative or spatial terms such as "front," "back," "top," "bottom," "upper," "lower," "left," and "right" are only used to distinguish the referenced elements and do not necessarily require particular positions or orientations in the cable connector assembly 100 or in the surrounding environment of the cable connector assembly 100. For example, the upper wall 116 may be oriented below the slot 112 instead of above the slot 112 if the connector assembly 100 is turned upside down relative to the surrounding environment.

The cable connector assembly 100 includes plural cables 122 that extend from the rear 108 of the housing 104. Although not shown in FIG. 1, the cables 122 may extend a long distance from the housing 104. The cables 122 may include center conductors 156, 158 (shown in FIG. 2) that propagate electrical signals therethrough. The center conductors 156, 158 may have a relatively large diameter or gauge to reduce signal loss of the propagating electrical signals over the long distance of the cables 122. The cable connector assembly 100 includes signal contacts 124 that terminate to the center conductors 156, 158 of the cables 122. The signal contacts 124 may extend at least partially into the slot 112 of the housing 104. The signal contacts 124 are configured to mechanically engage and electrically connect to corresponding signal contact pads 126 on the circuit card 102. The signal contact pads 126 connect to traces (not shown) on the circuit card 102 used to conduct electrical signals (for example, power and data signals) along the circuit card 102. In an exemplary embodiment, the signal contacts 124 of the cable connector assembly 100 may be configured to engage signal contact pads 126 disposed on both a top surface 128 and an opposite bottom surface 130 of the circuit card 102. For example, some signal contacts 124 may be disposed along the upper wall 116 of the housing 104 to engage signal contact pads 126 on the top surface 128, and other signal contacts 124 may be disposed along the lower wall 118 of the housing 104 to engage signal contact pads (not shown) on the bottom surface 130.

The cable connector assembly 100 also includes ground contacts 132. The ground contacts 132 may extend at least partially into the slot 112 of the housing 104. The ground contacts 132 are configured to mechanically engage and electrically connect to corresponding ground contact pads 134 on the circuit card 102. The ground contact pads 134 are electrically commoned with a ground plane (not shown) of the circuit card 102. The engagement between the ground contacts 132 and the ground contact pads 134 provides grounding to support the integrity of electrical signals transmitted between the cable connector assembly 100 and the circuit card 102. In an embodiment, the ground contacts 132 are disposed between signal contacts 124 to provide shielding for the signal contacts 124. For example, each ground contact 132 may be disposed between two adjacent pairs of signal contacts 124, as described further herein.

Figure 2:
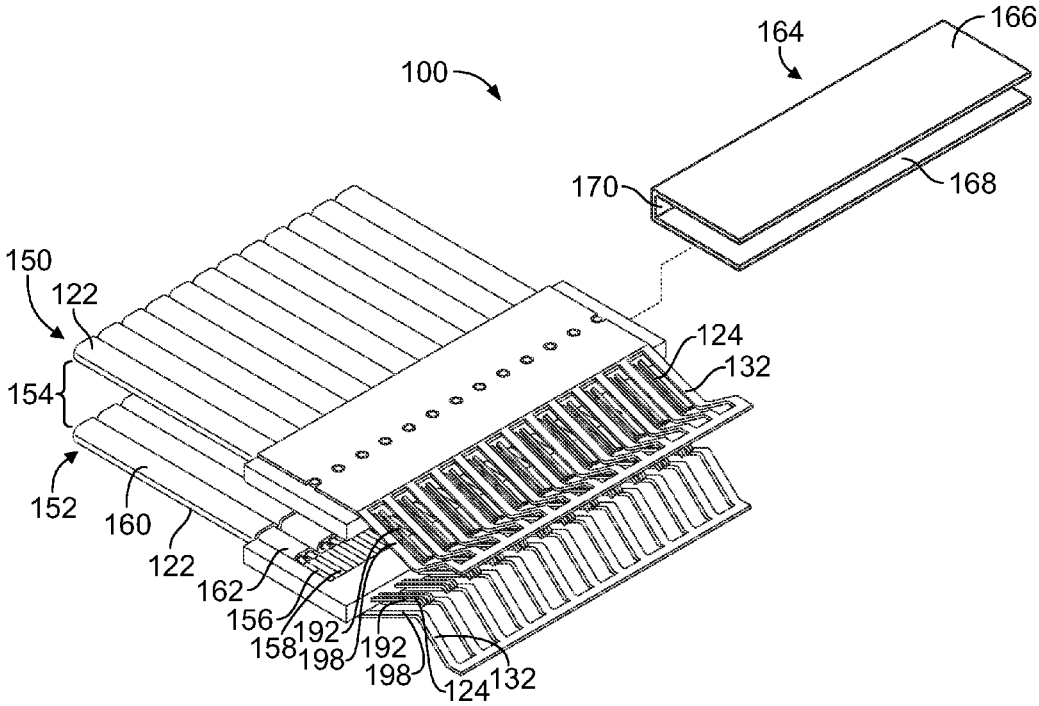
FIG. 2 is a partially exploded perspective view of an embodiment of the cable connector assembly of FIG. 1 shown without a housing.

FIG. 2 is a partially exploded perspective view of an embodiment of the cable connector assembly 100 of FIG. 1 shown without the housing 104 (shown in FIG. 1). The cable connector assembly 100 according to an exemplary embodiment includes a first cable contact module 150 and a second cable contact module 152. The first and second cable contact modules 150, 152 are received within the housing 104. The cable contact modules 150, 152 are separated by a gap 154. The gap 154 is aligned with the slot 112 (FIG. 1) at the front 106 (FIG. 1) of the housing 104. As the circuit card 102 (shown in FIG. 1) is received in the slot 112 during mating, the mating edge 114 (FIG. 1) extends into the gap 154 between the first and second cable contact modules 150, 152. As described further herein, each of the cable contact modules 150, 152 includes signal contacts 124 and ground contacts 132, and is terminated to plural cables 122. In an exemplary embodiment, the first and second cable contact modules 150, 152 may be at least substantially identical to each other. For example, the two cable contact modules 150, 152 may have the same components and be constructed and assembled according to the same processes. When the cable contact modules 150, 152 are assembled in the cable connector assembly 100, the first cable contact module 150 may mirror the second cable contact module 152, such that like sides face each other across the gap 154.

The cables 122 in an exemplary embodiment are twin axial cables having two center conductors, a first center conductor 156 and a second center conductor 158, within a common jacket 160 of the cable 122. The center conductors 156, 158 convey differential signals. In addition, each cable 122 includes a grounded element that electrically shields the center conductors 156, 158. In an exemplary embodiment, the center conductors 156, 158 are surrounded and shielded by a common cable shield or braid 162, which defines the grounded element of the cable 122. Additionally, or as an alternative to the single cable shield 162 that provides common shielding, the center conductors 156, 158 may be individually shielded, and the cables 122 may include a drain wire (not shown) within the jacket 160 of the cable 122 that is electrically connected to the shielding of the center conductors 156, 158. Other types of cables 122 may be provided in alternative embodiments. For example, the cables 122 may be coaxial cables each carrying a single center conductor therein.

The cable connector assembly 100 also includes a spacer 164. Although shown as exploded in FIG. 2, the spacer 164 is disposed within the gap 154 between the first and second cable contact modules 150, 152. The spacer 164 engages the first and second cable contact modules 150, 152 and preserves the spacing of the gap 154 therebetween. For example, the spacer 164 includes a first panel 166 and a second panel 168 coupled via a bridge 170. The first panel 166 is configured to engage the first cable contact module 150, and the second panel 168 is configured to engage the second cable contact module 152. The bridge 170 of the spacer 164 defines the height of the gap 154. The spacer 164 is formed of an electrically conductive material, such as metal. In an exemplary embodiment, the first panel 166 engages the cable shields (not shown) of the first cable contact module 150, and the second panel 168 engages the cable shields 162 of the second cable contact module 152 to electrically common the cable shields 162 of the first and second cable contact modules 150, 152.

Figure 3:
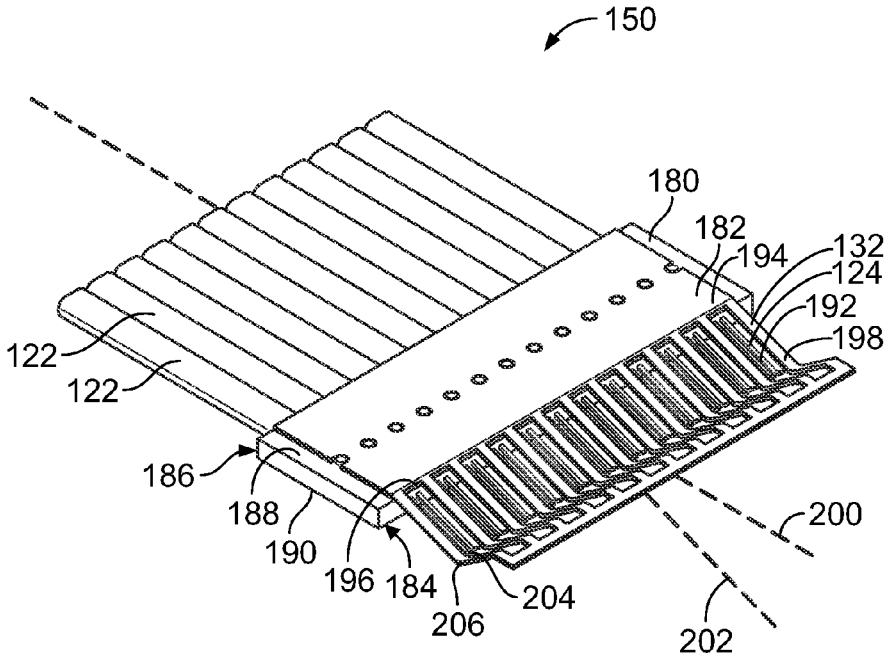
FIG. 3 is a top perspective view of a cable contact module formed in accordance with an exemplary embodiment.

FIG. 3 is a top perspective view of the cable contact module 150 formed in accordance with an exemplary embodiment. As described above, the first cable contact module 150 may be identical or at least similar to the second cable contact module 152 (shown in FIG. 2), such that the description of cable contact module 150 may apply as well to the cable contact module 152. The cable contact module 150 includes a dielectric frame 180, the signal contacts 124, and a ground frame 182. The dielectric frame 180 includes a front 184 and a rear 186. The dielectric frame 180 also includes an outer side 188 and an inner side 190. The dielectric frame 180 holds the signal contacts 124. In an embodiment, the dielectric frame 180 may be overmolded around the signal contacts 124. Alternatively, the dielectric frame 180 may hold the signal contacts 124 by an interference fit, adhesives, or the like. The dielectric frame 180 is formed of a dielectric material, such as plastic, that provides electrical insulation for the signal contacts 124.

The signal contacts 124 include or define contact beams 192 that extend from the front 184 of the dielectric frame 180. The contact beams 192 are configured to electrically connect to the signal contact pads 126 (shown in FIG. 1) on the mating circuit card 102 (FIG. 1). The contact beams 192 are composed of a metal, such as silver or copper, or another electrically conductive material. The signal contacts 124 are terminated to the cables 122 within the dielectric frame 180. The cables 122 extend from the rear 186 of the dielectric frame 180.

The ground frame 182 includes a ground plate 194 and the ground contacts 132. The ground plate 194 is mounted to the dielectric frame 180. For example, the ground plate 194 is secured to the outer side 188 of the dielectric frame 180. In an exemplary embodiment, the ground plate 194 engages the cable shields 162 (shown in FIG. 2) of the cables 122 to electrically common the grounding elements of the cables 122. The ground plate 194 includes a front edge 196 that may align generally with the front 184 of the dielectric frame 180. The ground contacts 132 include or define ground beams 198 that extend from the front edge 196 of the ground plate 194. The ground beams 198 are aligned with and extend between contact beams 192 to provide shielding. The ground beams 198 are configured to engage and electrically connect to corresponding ground contact pads 134 (shown in FIG. 1) on the circuit card 102 (FIG. 1). In an embodiment, the ground beams 198 are integral to the ground frame 182. For example, the ground frame 182 may be stamped and formed from a single panel of sheet metal or another conductive material, such that the ground plate 194 is formed integrally with the ground beams 198 extending therefrom.

In an embodiment, the contact beams 192 and the ground beams 198 form deflectable spring contacts that are configured to deflect at least partially when mated with the mating circuit card 102 (shown in FIG. 1). For example, the contact beams 192 may be cantilevered from the dielectric frame 180 that holds the signal contacts 124, and the ground beams 198 may be cantilevered from the ground plate 194. Optionally, the contact beams 192 may be curved proximate to distal ends of the contact beams 192 to define mating interfaces 204 that are configured to engage the signal contact pads 126 (shown in FIG. 1) of the circuit card 102. Similarly, the ground beams 198 may be curved to define mating interfaces 206 that are configured to engage the ground contact pads 134 (shown in FIG. 1) of the circuit card 102. The contact beams 192 and ground beams 198 may be spring biased against the circuit card 102 to maintain contact with the signal and ground contact pads 126, 134, respectively.

In an embodiment, the dielectric frame 180 and ground plate 194 are planar and oriented along a contact module axis 200. The contact beams 192 of the signal contacts 124 and the ground beams 198 are not planar with the dielectric frame 180 and the ground plate 194. For example, the contact beams 192 and the ground beams 198 extend along a beam axis 202 that is not parallel to the contact module axis 200. Thus, referring also back to FIG. 2, the contact beams 192 and ground beams 198 extend at least partially into the gap 154 between the first and second cable contact modules 150, 152. Referring now to FIG. 3 and FIG. 1, as the mating circuit card 102 is received within the slot 112, the surfaces 128, 130 of the circuit card 102 deflect the contact beams 192 and ground beams 198 outward. The biased spring force maintains engagement of the contact beams 192 and the ground beams 198 with the respective contact pads 126, 134 of the circuit card 102.

Figure 4:
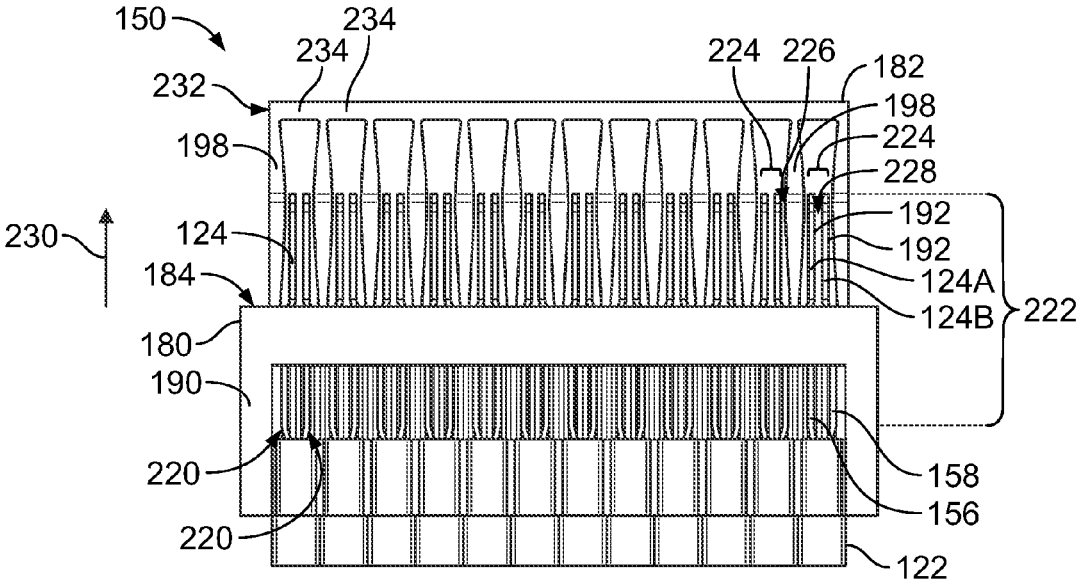
FIG. 4 is a bottom view of the cable contact module of FIG. 3.

FIG. 4 is a bottom view of the cable contact module 150 of FIG. 3. FIG. 4 shows the inner side 190 of the dielectric frame 180, which would be facing the gap 154 (shown in FIG. 2). The dielectric frame 180 includes channels 220 therein that hold and separate the signal contacts 124. The channels 220 may be oriented to hold the signal contacts 124 in a row 222. Optionally, the channels 220 may be parallel to each other such that the signal contacts 124, including the contact beams 192 extending from the front 184 of the dielectric frame 180, are parallel to each other. In an embodiment, each signal contact 124 terminates to one of the center conductors 156, 158 of each cable 122. As such, a signal contact 124A may terminate to the first center conductor 156 of one cable 122, and an adjacent signal contact 124B may terminate to the second center conductor 158 of the cable 122. The center conductors 156, 158 may be configured to convey differential signals through the cable 122. Similarly, the adjacent signal contacts 124A, 124B that terminate to the center conductors 156, 158, respectively, are arranged in a pair 224 (for example, a differential pair). Each pair 224 of signal contacts 124 may be terminated to the center conductors 156, 158 of a different cable 122. In an exemplary embodiment, the pairs 224 of signal contacts 124 have a void 226 that is defined between the contact beams 192 of adjacent pairs 224 of signal contacts 124. For example, each void 226 is a space that is wider than the interstitial space 228 between the contact beams 192 of one pair 224.

In an exemplary embodiment, each ground beam 198 of the ground frame 182 extends into a corresponding void 226 between adjacent pairs 224 of the contact beams 192. Thus, along a width of the cable contact module 150, the beams may be arranged in a repeating pattern of ground beam-contact beam-contact beam-ground beam-contact beam-contact beam. The ground beams 198 may provide shielding between the adjacent pairs 224 of contact beams 192.

The contact beams 192 extend in a forward direction 230 from the front 184 of the dielectric frame 180. In an embodiment, the ground beams 198 extend in the forward direction 230 further than the contact beams 192. Upon mating with the mating circuit card 102 (shown in FIG. 1), the ground beams 198 engage the circuit card 102 before the contact beams 192 engage the circuit card 102. The ground beams 198 may be angled to gradually guide the mating circuit card 102 into the gap 154 (shown in FIG. 2) between the first and second cable contact modules 150, 152 (FIG. 2). For example, if the mating circuit card 102 is not properly aligned relative to the cable connector assembly (shown in FIGS. 1 and 2) during mating, the ground beams 198 may absorb the impact from the mating edge 114 (FIG. 1) instead of the contact beams 192, to prohibit damage to the contact beams 192. In an embodiment, a distal end 232 of each of the ground beams 198 may be connected to at least one adjacent ground beam 198 via a link 234. The links 234 connect the ground beams 198 to support the beams 198 and maintain the spacing between adjacent beams 198. For example, without the links 234, the mating edge 114 of the mating circuit card 102 may bend one or more ground beams 198 out of place relative to the other ground beams 198, interfering with the protection, shielding, and/or grounding functions of the ground beams 198.

Figure 5:
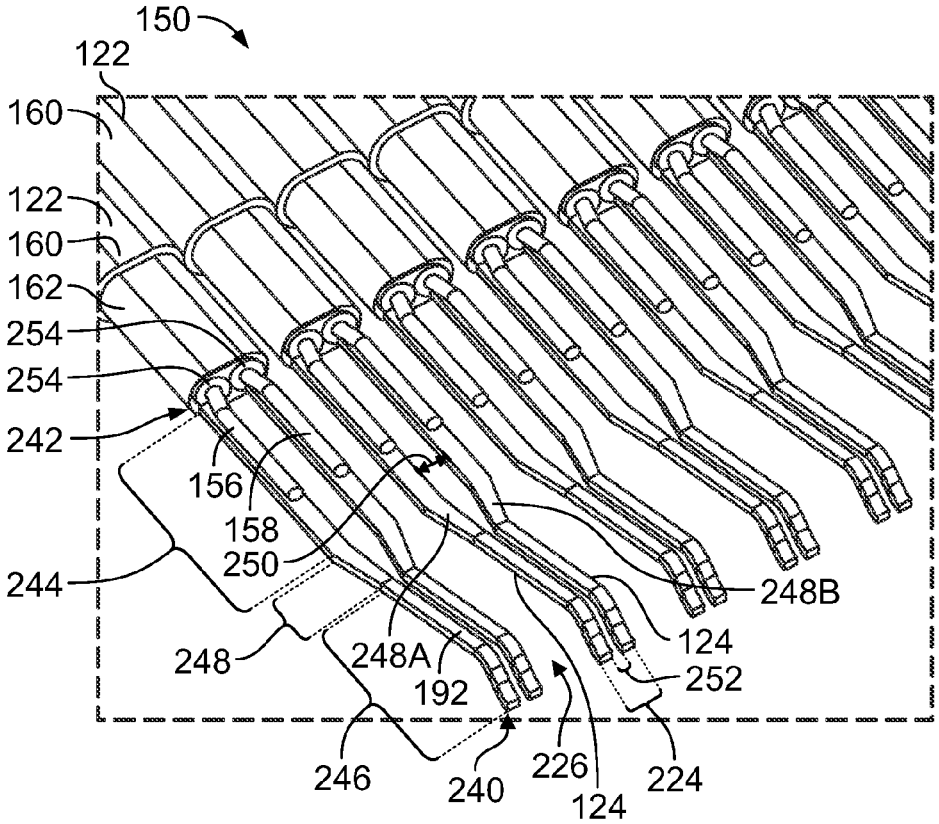
FIG. 5 is a bottom perspective view of a portion of the cable contact module of FIG. 3 shown without a ground frame and a dielectric frame.

FIG. 5 is a bottom perspective view of a portion of the cable contact module 150 of FIG. 3 shown without the ground frame 182 and the dielectric frame 180. The signal contacts 124 extend between mating ends 240 and terminating ends 242. The signal contacts 124 include termination segments 244 at the terminating ends 242. The termination segments 244 terminate to corresponding center conductors 156, 158 of the cables 122. For example, the termination segments 244 may be welded, such as by resistance welding or ultrasonic welding, to exposed portions of the center conductors 156, 158. Alternatively, the termination segments 244 may be terminated by other means or processes, such as by soldering, insulation displacement contacts, or like means. The signal contacts 124 include mating segments 246 at the mating ends 240. The mating segments 246 of the signal contacts 124 form or define the contact beams 192.

In an exemplary embodiment, the signal contacts 124 also include transition segments 248 between the termination segments 244 and the mating segments 246. The transition segments 248 are used to alter the spacing between the two signal contacts 124 in each pair 224. For example, although the termination and mating segments 244, 246 of the signal contacts 124 in each pair 224 may be parallel, in an embodiment, the transition segment 248A of one signal contact 124 in the pair 224 is not parallel with the transition segment 248B of the other signal contact 124. The transition segments 248A, 248B may extend gradually towards each other in a direction away from the cables 122. As a result, a termination contact spacing 250 between adjacent termination segments 244 in each pair 224 is greater than a mating contact spacing 252 between the mating segments 246 of the same two signal contacts 124 in the pair 224. The transition segments 248 neck the signal contacts 124 from a wider separation between adjacent termination segments 244 to a narrower separation between adjacent mating segments 246 of each pair 224.

The mating contact spacing 252 is sized for the contact beams 192 to engage corresponding signal contact pads 126 (shown in FIG. 1) on the mating circuit card 102 (FIG. 1). For example, the circuit card 102 may be designed with an increased density of contact pads, and the signal contact pads 126 may have a narrow pitch 256 (FIG. 1) between the midpoints of adjacent contact pads 126. For example, the pitch 256 may be less than 1 millimeter (mm), such as 0.5 mm or 0.4 mm. In an embodiment, the reduced mating contact spacing 252 between contact beams 192 in the same pair 224 of signal contacts 124 provides a larger void 226 between adjacent pairs 224. The voids 226 receive the ground beams 198 (shown in FIG. 4) of the ground frame 182 (FIG. 4).

In an embodiment, the termination contact spacing 250 is sized in order to accommodate cables 122 that include relatively large gauge center conductors 156, 158. As used herein, gauge means the diameter or cross-sectional area of the conductive material used to convey signals through the cables 122. For example, each cable 122 shown in FIG. 5 includes two center conductors 156, 158 that are each individually surrounded by an insulation layer 254. In addition, the center conductors 156, 158 and insulation layers 254 are surrounded by the cable shield 162 and the cable jacket 160. As the size of the center conductors 156, 158 increase, so too may the layers surrounding the center conductors 156, 158, which increases the diameter of the cables 122. There may be a limited range of termination contact spacing 250 between the signal contacts 124 in each pair 224 that allows the center conductors 156, 158 to be terminated to the termination segments 244. For example, if the termination contact spacing is reduced, such as to the width of the mating contact spacing 252 shown in FIG. 5, the center conductors 156, 158 may be unable to terminate to the termination segments 244 because the insulation layers 254 between the conductors 156, 158 may prevent arranging the center conductors 156, 158 with sufficiently close spacing to terminate to the narrow-spaced termination segments 244. Stated another way, the width of the termination contact spacing 250 may be restricted (for example, both in terms of upper limits on width and lower limits on width) due to factors such as the radial thickness of the insulation layers 254 that separate the center conductors 156, 158, the bend properties of the center conductors 156, 158, and the like. As a result, the center conductors 156, 158 may have a gauge that is too large (for example, the insulation layers 254 too thick or the conductors 156, 158 too rigid) for adjacent center conductors 156, 158 to connect directly to corresponding adjacent signal contact pads 126 (shown in FIG. 1). Tooling the signal contacts 124 such that the termination contact spacing 250 is greater than the mating contact spacing 252 allows the signal contacts 124 to electrically connect to both the center conductors 156, 158 and the signal contact pads 126.

During assembly of the cable contact module 150, the center conductors 156, 158 of the cables 122 may be terminated by welding, for example, to the termination segments 244 of the signal contacts 124. Then, the signal contacts 124 with attached center conductors 156, 158 may be loaded into, or overmolded by, the dielectric frame 180 (shown in FIG. 4). In an alternative order of assembly, the signal contacts 124 may be loaded into the channels 220 of the dielectric frame 180 prior to termination to the cables 122. For example, the center conductors 156, 158 may be presented to and terminated to the signal contacts 124 after the signal contacts 124 are within the dielectric frame 180.

Figure 6:
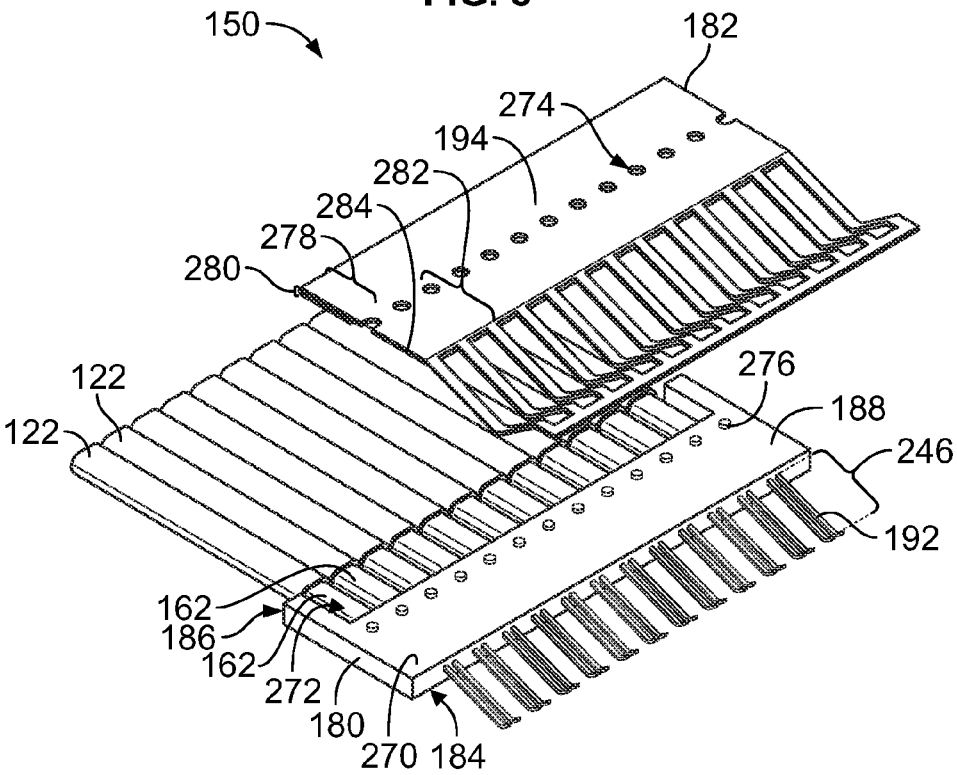
FIG. 6 is a partially exploded perspective view of the cable contact module of FIG. 3 according to an embodiment.

FIG. 6 is a partially exploded perspective view of the cable contact module 150 of FIG. 3 according to an embodiment. As shown in FIG. 6, the cable contact module 150 may be partially assembled, with the ground frame 182 poised for mounting to the outer side 188 of the dielectric frame 180. The outer side 188 of the dielectric frame 180 includes a wall 270. The wall 270 covers the termination segments 244 (shown in FIG. 5) and the transition segments 248 (FIG. 5) of the signal contacts 124. The contact beams 192, forming the mating segments 246, extend from the front 184 of the dielectric frame 180. The wall 270 defines a window 272 that extends through the wall 270. In an exemplary embodiment, the window 272 aligns with the cable shields 162 of the cables 122, such that the cable shields 162 are at least partially exposed through the window 272 and not covered by the wall 270. The window 272 may be located along the rear 186 of the dielectric frame 180. The window 272 extends across at least most of the width of the dielectric frame 180, such that all of the cable shields 162 of the cables 122 terminated to the cable contact module 150 are exposed through the window 272.

During assembly, the ground frame 182 is mounted to the outer side 188 of the dielectric frame 180. For example, the ground plate 194 is placed on and abuts the wall 270. In an exemplary embodiment, at least a portion of the ground plate 194 extends over and/or into the window 272 and engages the cable shields 162 of the cables 122. For example, the cable shields 162 may be at least slightly recessed from the top surface of the wall 270. In order to engage the cable shields 162, a rear portion 278 of the ground plate 194 has a thickness 280 that is greater than a thickness 284 of a front portion 282. The front portion 282 abuts the wall 270, and the rear portion 278, due to the greater thickness 280, extends at least partially into the window 272 and engages the cable shields 162. As described above, the ground frame 182 is formed of an electrically conductive material, such as a metal, and by engaging each of the cable shields 162 of the cables 122, the ground frame 182 electrically commons each of the cable shields 162 (or other grounding elements) of the cables 122.

In an embodiment, the ground plate 194 includes a securing feature 274 that is configured to couple the ground frame 182 to the dielectric frame 180. Optionally, the dielectric frame 180 includes a complementary securing feature 276 that interacts with the securing feature 274 on the ground plate 194. For example, as shown in the illustrated embodiment, the securing feature 274 may be multiple apertures in the ground plate 194. The complementary securing feature 276 on the dielectric frame 180 may be plural posts that are each configured to be received in a corresponding aperture in the ground plate 194. The ground frame 182 may be secured to the dielectric frame 180 by an interference fit between the posts and edges of the apertures, by an adhesive, and/or by a welding or soldering process. In other embodiments, other securing features 274, 276 may be used instead of or in addition to posts and apertures, such as latches, tabs, adhesives, and the like.

Figure 7:
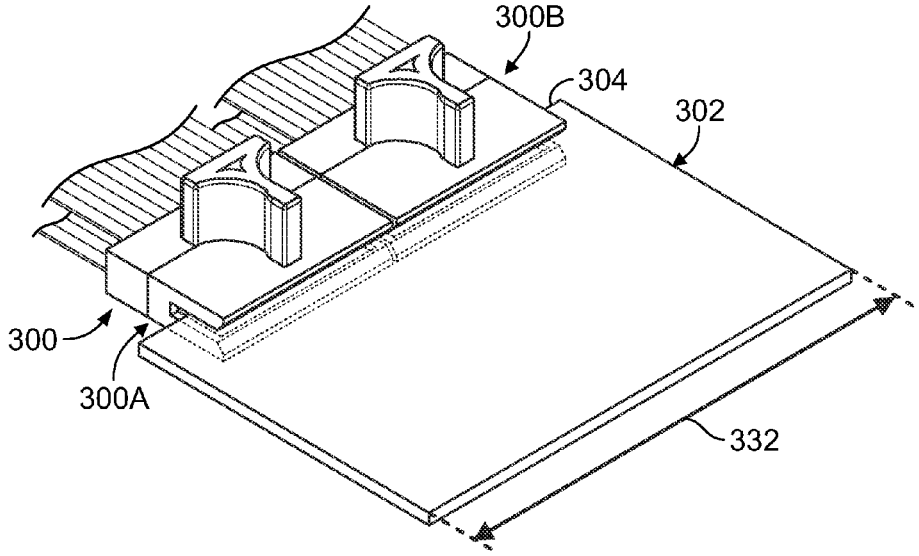
FIG. 7 is a perspective view of two cable connector assemblies formed in accordance with an embodiment that are mated to a common circuit card.

FIG. 7 is a perspective view of two cable connector assemblies 300, formed in accordance with an embodiment, that are mated to a common circuit card 302. The cable connector assemblies 300 may each be the cable connector assembly 100 shown in FIG. 1. The circuit card 302 may be the mating circuit card 102 shown in FIG. 1. The two cables connector assemblies 300 may be identified individually as a first cable connector assembly 300A and a second cable connector assembly 300B. The cable connector assemblies 300 are mated side-by-side along the same mating edge 304 of the circuit card 302.

Figure 8:
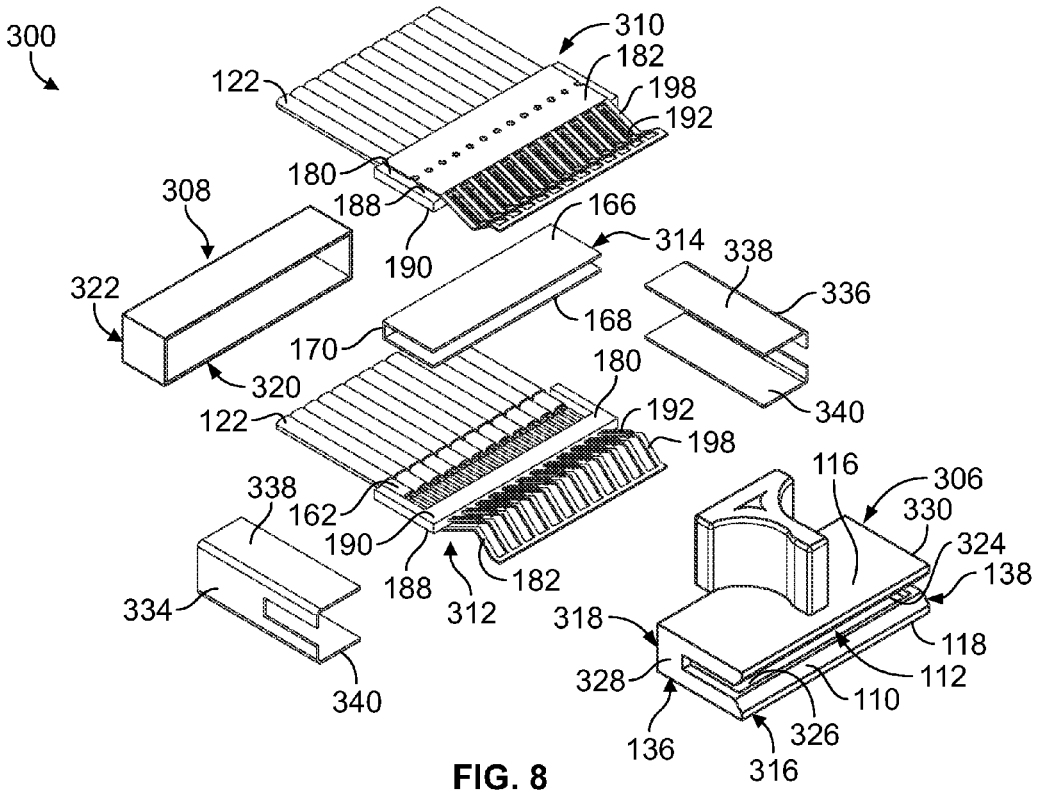
FIG. 8 is an exploded perspective view of a cable connector assembly according to an exemplary embodiment.

FIG. 8 is an exploded perspective view of one of the cable connector assemblies 300 shown in FIG. 7 according to an exemplary embodiment. The cable connector assembly 300 includes a front housing 306, a backside housing 308, a first cable contact module 310, a second cable contact module 312, and a spacer 314. The first and second cable contact modules 310, 312 may be the first and second cable contact modules 150, 152 shown and described in FIG. 2. The spacer 314 may be the spacer 164 shown and described in FIG. 2.

In an embodiment, the front housing 306 and the backside housing 308 may together form the housing 104 of the cable connector assembly 100 shown in FIG. 1. For example, the front housing 306 includes a front 316 and a rear 318. The front 316 of the front housing 306 includes the mating interface 110 that defines the slot 112. The backside housing 308 also includes a front 320 and a rear 322. The backside housing 308 surrounds at least a portion of the cable contact modules 310, 312 and the spacer 314. The front 320 of the backside housing 308 engages the rear 318 of the front housing 306.

The first and second cable contact modules 310, 312 are received in the front housing 306 through the rear 318. For example, the contact beams 192 and ground beams 198 of the first cable contact module 310 are received and disposed along an upper interior wall 324 of the front housing 306, and the contact beams 192 and ground beams 198 of the second cable contact module 312 are received and disposed along a lower interior wall 326. As described above with reference to FIG. 1, the contact beams 192 and the ground beams 198 may form deflectable spring contacts that extend at least partially into the slot 112 from above and from below, based on the respective location of the corresponding cable contact modules 310, 312, and are configured to deflect as the mating edge 114 (shown in FIG. 1) of the circuit card 102 (FIG. 1) is received within the slot 112. For example, with additional reference to FIG. 1, the contact beams 192 and ground beams 198 along the upper interior wall 324 may be configured to electrically engage respective signal contact pads 126 and ground contact pads 134 on the top surface or side 128 of the circuit card 102, and the contact beams 192 and ground beams 198 along the lower interior wall 326 may be configured to electrically engage respective signal and ground contact pads 126, 134 on the bottom surface or side 130.

The spacer 314 is disposed between the cable contact modules 310, 312, and supports a gap 154 (shown in FIG. 2) therebetween. The first and second cable contact modules 310, 312 oppose each other such that the inner sides 190 face each other (for example, face the spacer 314) across the gap 154, and the outer sides 188 face outwardly away from the gap 154 and the spacer 314. When the connector assembly 300 is assembled, the first panel 166 of the spacer 314 engages the cable shields (not shown in FIG. 8) of the cables 122 along the inner side 190 of the dielectric frame 180 of the first cable contact module 310. The second panel 168 of the spacer 314 engages the cable shields 162 of the cable 122 along the inner side 190 of the dielectric frame 180 of the second cable contact module 312. The first and second panels 166, 168 of the spacer 314 are coupled by the bridge 170. As such, in an exemplary embodiment, the cable shields (or another grounding element) of the cables 122 of the first cable contact module 310 are electrically commoned to the cable shields 162 (or other grounding element) of the cables 122 of the second cable contact module 312 via the panels 166, 168 and bridge 170 of the spacer 314 when the cable connector assembly 300 is assembled. In an exemplary embodiment, the spacer 314 provides shielding and grounding between the cable contact modules 310, 312 within the gap 154 (shown in FIG. 2), and the ground frames 182 provide shielding and grounding along the outer sides of the respective cable contact modules 310, 312.

The front housing 306 includes a left wall 328 at the left end 136 and a right wall 330 at the right end 138. The slot 112 extends between the left and right ends 136, 138. In an exemplary embodiment, the slot 112 extends through the left and right walls 328, 330. For example, the slot 112 may be defined from above by the upper wall 116 and from below by the lower wall 118, but the slot 112 is undefined at the left and right ends 136, 138. As a result, the front housing 306 of the cable connector assembly 300 is able to accommodate various mating configurations between the cable connector assembly 300 and the mating circuit card 302 (shown in FIG. 7). For example, since the slot 112 is not bordered at the ends 136, 138, the cable connector assembly 300 may be mated to the circuit card 302 at various locations and in various configurations, such as side-by-side with one or more other cable connector assemblies 300, as shown in FIG. 7. Referring back to FIG. 7, the mating edge 304 of the circuit card 302 does not need to include various slots or perforations that are sized with predefined lengths along the length 332 of the circuit card 302 to fit within the slot 112 of a single connector assembly 300. Instead, the mating edge 304 may be linear along the length 332, and the cable connector assembly 300 may be located at various positions along the length 332 to connect to selected circuitry. In addition, multiple connector assemblies 300A, 300B may be disposed side-by-side in groups to mate with the circuit card 302 as a constructive larger connector assembly.

Referring back to FIG. 8, in an embodiment, the cable connector assembly 300 includes a left bracket 334 and a right bracket 336. The left bracket 334 couples to the upper and lower walls 116, 118 of the front housing 306 at the left end 136. The right bracket 336 couples to the upper and lower walls 116, 118 of the front housing 306 at the right end 138. The left and right brackets 334, 336 are configured to reinforce the relative spacing between the upper and lower walls 116, 118 of the front housing 306. For example, since the slot 112 is not defined at the left and right ends 136, 138, the upper and lower walls 116, 118 at the mating interface 110 may have a tendency to be forced apart, such as while inserting the mating card 102 (shown in FIG. 1) into the slot 112. As the upper and lower walls 116, 118 are pushed apart, the walls 116, 118 provide less protection of and/or biasing force to the contact beams 192 and ground beams 198 within the front housing 306, which may damage the electrical connection and/or the components of the connector assembly 300. The left and right brackets 334, 336 include an upper panel 338 and a lower panel 340. The left bracket 334 is placed on the left end 136 of the front housing 306, and the right bracket 336 is placed on the right end 138. The upper panels 338 are each disposed over the upper wall 116 proximate to the respective end 136, 138, and the lower panels 340 are disposed below the lower wall 118 at the respective ends 136, 138. The panels 338, 340 effectively bookend the upper and lower walls 116, 118 from above and below, prohibiting the walls 116, 118 from moving apart.

One or more embodiments of the cable connector assembly described herein has as a technical effect, the ability to terminate cables having large gauge center conductors to narrow pitch signal contact pads on a mating circuit card. As a result, the cables may be able to convey electrical signals over a longer transmission path with less signal loss than with smaller gauge center conductors. Another technical effect of one or more embodiments of the cable connector assembly described herein is effective electrical grounding and commoning of the cables within each cable contact module of the cable connector assembly via a ground plate. In addition, another technical effect is effective grounding and commoning of the cables between the cable contact modules of the cable connector assembly via a conductive spacer. Moreover, the cable contact modules each include a ground frame that includes both the ground plate and integral ground beams extending therefrom into a void between adjacent pairs of signal contacts to provide shielding therebetween. The ground frame is mounted to a dielectric frame that holds the signal contacts, so the ground beams are not held within the dielectric frame, where space may be very limited. A technical effect of this ground frame arrangement is that assembly of the contact modules is both simpler and easier.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A cable contact module comprising:

a dielectric frame having a front and a rear;

signal contacts held by the dielectric frame, the signal contacts including contact beams that extend from the front of the dielectric frame and are configured to electrically connect to signal contact pads on a mating circuit card, the signal contacts arranged in pairs with a void defined between the contact beams of adjacent pairs, the signal contacts terminated to corresponding cables that extend from the rear of the dielectric frame, each cable including at least one center conductor housed within a cable shield; and a ground frame that includes a ground plate and integral ground beams, the ground plate is mounted to the dielectric frame and engages the cable shields of the cables, each ground beam extending from a front edge of the ground plate into a corresponding void between the contact beams of adjacent pairs of signal contacts, the ground beams configured to electrically connect to ground contact pads on the mating circuit card;

wherein each signal contact includes a termination segment that is configured to terminate to a center conductor of one of the cables, a mating segment that forms the contact beam, and a transition segment between the termination segment and the mating segment, wherein the transition segment of one signal contact in each pair is not parallel with the transition segment of the other signal contact in the pair such that a termination contact spacing between the termination segments of the pair of signal contacts is greater than a mating contact spacing between the mating segments.

2. The cable contact module of claim 1, wherein the center conductors of the cables have a gauge that is too large for adjacent center conductors to connect directly to corresponding adjacent signal contact pads on the mating circuit card due to a narrow pitch between adjacent signal contact pads, and wherein the termination contact spacing being greater than the mating contact spacing allows the signal contacts to electrically connect to both the center conductors and the signal contact pads.

3. The cable contact module of claim 1, wherein the ground plate electrically commons the cable shields of the cables.

4. The cable contact module of claim 1, wherein the contact beams and the ground beams form deflectable spring contacts that deflect when mated with the mating circuit card.

5. The cable contact module of claim 1, wherein the ground plate of the ground frame includes a securing feature that is configured to couple to a complementary securing feature on the dielectric frame to mount the ground frame to the dielectric frame.

6. The cable contact module of claim 1, wherein the ground plate of the ground frame is mounted on an outer side of the dielectric frame, the outer side of the dielectric frame including a window through which the ground plate engages the cable shields of the cables.

7. The cable contact module of claim 1, wherein the ground frame is stamped and formed from a single panel of sheet metal.

8. The cable contact module of claim 1, wherein each signal contact of the pair is terminated to a corresponding one of two center conductors commonly housed within the cable shield of one cable, the two center conductors forming a differential signal pair.

9. The cable contact module of claim 1, wherein the contact beams extend forward from the front of the dielectric frame and the ground beams extend further forward than the contact beams such that, upon mating with the mating circuit card, the ground beams engage the mating circuit card before the contact beams engage the mating circuit card.

10. The cable contact module of claim 1, wherein the signal contacts are held in a row by the dielectric frame.

11. A cable connector assembly comprising:

a front housing having a front and a rear, the front including a mating interface configured to receive a mating edge of a mating circuit card;

first and second cable contact modules received in the front housing, the first and second cable contact modules separated from each other by a gap, each cable contact module comprising:

plural cables each including at least one center conductor housed within a cable shield;

a dielectric frame having a front and a rear and an outer side and an inner side, the dielectric frame holding multiple signal contacts, the signal contacts terminated to the center conductors of the cables, the cables extending from the rear of the dielectric frame, the signal contacts including contact beams that extend from the front of the dielectric frame; and a ground frame mounted to the outer side of the dielectric frame, the ground frame including a ground plate engaging the cable shields of the cables and integral ground beams extending from a front edge of the ground plate into corresponding voids defined between adjacent pairs of contact beams, wherein the first and second cable contact modules oppose each other such that the inner sides of the dielectric frames face each other across the gap; and a spacer having a first panel and a second panel coupled by a bridge, the spacer disposed in the gap between the first and second cable contact modules such that the first panel is configured to engage the cable shields of the cables along the inner side of the first cable contact module, and the second panel is configured to engage the cable shields of the cables along the inner side of the second cable contact module.

12. The cable connector assembly of claim 11, further comprising a backside housing that engages the rear of the front housing, the backside housing surrounding at least a portion of the first and second cable contact modules and the spacer therebetween.

13. The cable connector assembly of claim 11, wherein the spacer electrically commons the cable shields of the cables in the first cable contact module with the cable shields of the cables in the second cable contact module.

14. The cable connector assembly of claim 11, wherein each signal contact includes a termination segment that is configured to terminate to one center conductor of one of the cables, a mating segment that forms the contact beam, and a transition segment between the termination segment and the mating segment, wherein the transition segment of one signal contact in each pair is not parallel with the transition segment of the other signal contact in the pair such that a termination contact spacing between the termination segments of the pair of signal contacts is greater than a mating contact spacing between the mating segments.

15. The cable connector assembly of claim 11, wherein a distal end of each ground beam of the ground frame is connected to at least one adjacent ground beam via a link.

16. The cable connector assembly of claim 11, wherein the front housing includes a left wall at a left end and a right wall at a right end, the mating interface at the front defining a slot that extends between the left and right ends, the slot extending through the left and right walls, allowing the front housing to accommodate various mating configurations between the cable connector assembly and the mating circuit card.

17. The cable connector assembly of claim 16, wherein the front housing includes an upper wall that defines the slot from above and a lower wall that defines the slot from below, the cable connector assembly further comprising a left bracket that couples to the upper and lower walls at the left end and a right bracket that couples to the upper and lower walls at the right end, the left and right brackets configured to reinforce the relative spacing between the upper and lower walls.

18. The cable connector assembly of claim 11, wherein the mating interface of the front housing defines a slot that receives the mating edge of the mating circuit card therein, the contact beams and the ground beams of the first cable contact module disposed along an upper interior wall of the front housing and are configured to electrically engage respective signal pads and ground pads on a top side of the mating circuit card, the contact beams and the ground beams of the second cable contact module disposed along a lower interior wall of the front housing and are configured to electrically engage respective signal pads and ground pads on a bottom side of the mating circuit card.

19. The cable connector assembly of claim 18, wherein the contact beams and the ground beams of the first and second cable contact modules form deflectable spring contacts that extend at least partially into the slot from above and below, respectively, and are configured to deflect as the mating edge of the mating circuit card is received within the slot.

* * * * *